United States Patent [19]

Dallaire et al.

[11] Patent Number: 5,054,135

[45] Date of Patent: Oct. 8, 1991

[54] ABOVE GROUND POOL

[75] Inventors: Michel Dallaire, Montreal; Michel Seguin, Hull, both of Canada

[73] Assignee: Vogue Industries Ltd., LaSalle, Canada

[21] Appl. No.: 450,312

[22] Filed: Dec. 15, 1989

[51] Int. Cl.[5] ..... E04H 4/00; E04B 1/346

[52] U.S. Cl. ..... 4/506; 4/488; 52/71

[58] Field of Search ..... 4/506, 487, 494, 488, 4/513; 52/71, 169.6, 169.7

[56] References Cited

U.S. PATENT DOCUMENTS

| | | | |
|---|---|---|---|
| 3,233,251 | 2/1966 | Barrera | 4/172 |
| 3,268,917 | 8/1966 | Diemond et al. | 4/172 |
| 3,280,408 | 10/1966 | Gershman | 4/506 |
| 3,439,362 | 4/1969 | Goettl | 4/506 |
| 3,644,942 | 2/1972 | Haight | 4/506 |
| 3,748,665 | 7/1973 | Veissmann | 4/506 |
| 3,874,132 | 4/1975 | Mendelow et al. | 52/71 |
| 3,934,277 | 1/1976 | Quivouette | 4/506 |
| 3,955,220 | 5/1976 | Kessler | 4/506 |
| 4,062,158 | 12/1977 | Kaufmann et al. | 52/71 |
| 4,370,839 | 2/1983 | Blakeway | 4/506 |
| 4,623,126 | 10/1986 | Pettit | 4/496 |
| 4,847,926 | 7/1989 | Laputka | 4/506 |

*Primary Examiner*—Henry J. Recla
*Assistant Examiner*—Keith Kupferschmid
*Attorney, Agent, or Firm*—Foley & Lardner

[57] ABSTRACT

A molded plastics framework for an above-ground swimming pool which includes an endless molded base member having post sockets and a continuous cove integral therewith. The base member is made up of a plurality of identical molded modules which are connected together end to end to make up the endless base member. Molded plastics posts are secured in the base socket and extend upwardly in a spaced apart manner and receive an endless ledge made up of molded ledge segments connected end to end above the posts.

12 Claims, 5 Drawing Sheets

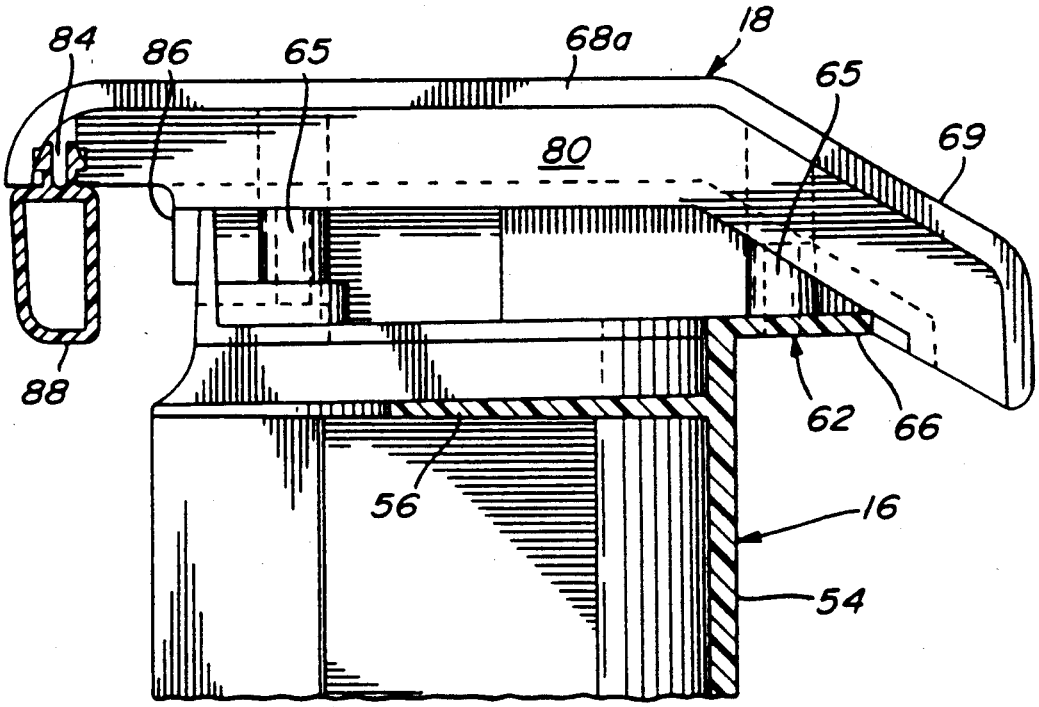
FIG. 8
FIG. 6
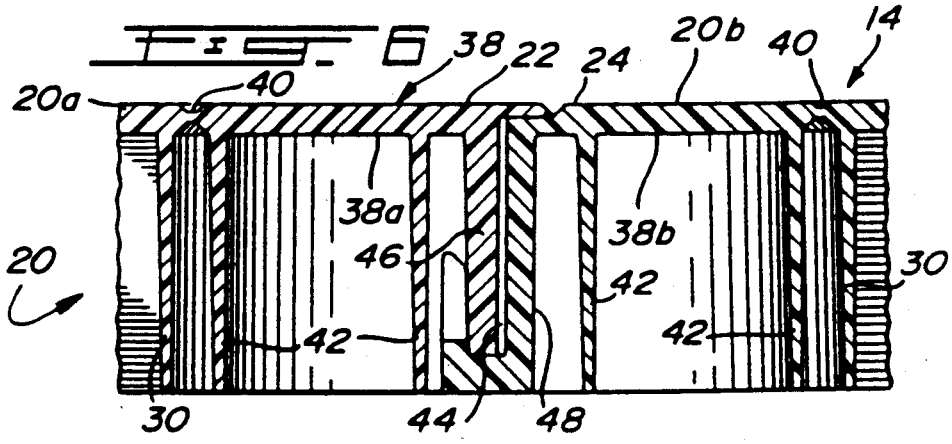
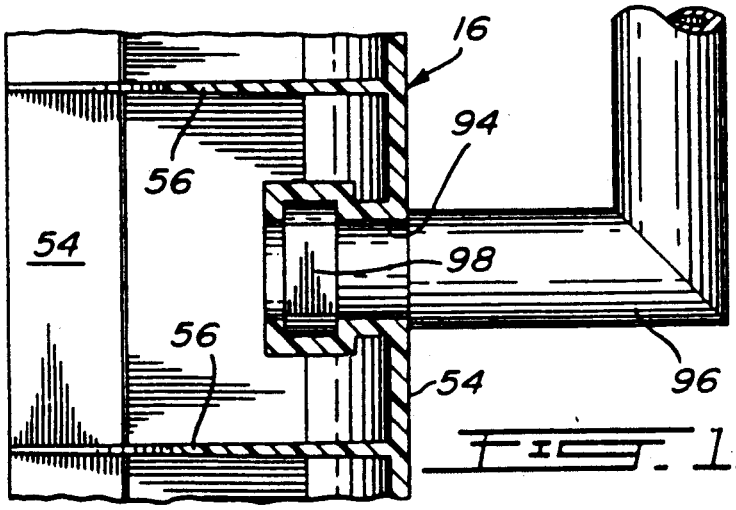
FIG. 11

ABOVE GROUND POOL

BACKGROUND OF THE INVENTION

1. Field of the Invention

The present invention relates to swimming pools and more particularly to a frame construction for an above-ground pool.

2. Description of the Prior Art

Traditionally, above-ground pools are constructed out of steel, aluminimum or molded thermoplastic material and have the same components regardless of the materials. The components making up the framework for an above-ground pool include rail sections connected to separate base plates; vertical uprights or posts set on the base plates and coping or ledge sections, normally connected together over the posts; and, cap members to cover the joints over the posts. A flexible side retaining wall of sheet metal or relatively thick plastic is provided and is held in the rail and by the coping and a liner, normally of flexible vinyl plastic, is supported on the upper edge of the retaining wall. Examples of such conventional pool frames can be found in U.S. Pat. Nos. 3,268,917 Diamond et al 1965; 3,233,251 Barrera 1966; 3,874,132 Mendelow et al 1975; 4,062,158 Kaufmann et al 1977; and 4,847,926 Laputka 1989. Only Mendelow et al shows any attempt to reduce the number of parts in connecting the coping sections by providing interconnecting plastic molded ledge sections which avoid the necessity of a cap and accessories for instance.

Above-ground pools are usually sold as do-it-yourself kits. The purchaser must assemble the pool on site. Given that such swimming pools are typically in the 12' to 30' range, the task of assembling the pool from the kit can be formidable. Each post assembly, for instance, requires several parts and fasteners to join the post to the base plate and to the coping. Kaufmann illustrates this problem. Typically, the larger the pool, the more parts are required since the size of the parts are generally not scaled up, but more parts are added to the kits.

The assembly of a conventional above-ground pool also requires a considerably large crew, either volunteered or hired, since it is not possible to do it alone. While assembling the pool several persons must stand by the posts to support and align the posts. The independent base plates connected to lightweight rails cannot support the posts in upright alignment without other supports such as the completed top coping.

SUMMARY OF THE INVENTION

It is an aim of the present invention to provide an improved above-ground pool construction which requires fewer parts.

It is a further aim of the present invention to provide an improved framework for an above ground pool which includes molded thermoplastic modular elements, made to interconnect one with the other to provide an integrated frame.

It is a further aim of the present invention to provide an improved above-ground pool which is easier to assemble, requiring fewer people.

A construction in accordance with the present invention includes a framework for an above-ground pool comprising an uninterrupted base member made up of a plurality of molded interconnected base member sections defining a continuous groove for receiving the retaining wall. The base member also includes spaced apart sockets for receiving upright posts. Each interconnected base member section has first and second ends, wherein the first end of one base member section includes vertical male interconnecting portions and the second end includes a vertical female interconnecting portion adapted to engage and be interlocked with the first end of an adjacent base member. Posts extend upwardly from each post socket in the base member and an uninterrupted coping extends along the top of the posts. Means are provided in the coping to receive the top of the posts and fasteners secure the posts in the base sockets and the ledge. The coping includes interconnecting coping segments with each segment including a first and second end. The first end has a vertical male interconnecting portion and the second end has a vertical female interconnecting portion adapted to engage and be interlocked with the first end of an adjacent segment. The ledge is provided with means for retaining the upper edge of the retaining wall.

In a more specific embodiment of the present invention, the base member sections each include an elongated stem portion and a portion of the post socket at the first end and a complementary portion of the post socket on the second end. The groove is defined along the stem and the socket portions. A cove member may also form part of the base member and is coextensive with the stem and socket portions.

In yet a more specific embodiment the post member is provided with a shoe at the top thereof for receiving the coping. The shoe includes flange members extending at right angles to the axis of the post and fastening means are provided for attaching the ledge to the flanges. Preferably the coping segments interconnect at a post location such that the first end of a coping segment is fastened to a portion of the shoe while a second end of an adjacent coping segment is fastened to another portion of the same shoe.

BRIEF DESCRIPTION OF THE DRAWINGS

Having thus generally described the nature of the invention, reference will now be made to the accompanying drawings, showing by way of illustration, a preferred embodiment thereof, and in which:

FIG. 6 is an enlarged fragmentary vertical cross-section taken along line 6—6 of FIG. 5;

FIG. 8 is an enlarged fragmentary vertical cross-section taken along line 8—8 of FIG. 7;

FIG. 11 is an enlarged fragmentary vertical cross-section of a further detail of the present invention.

DESCRIPTION OF THE PREFERRED EMBODIMENTS

Figure 1:
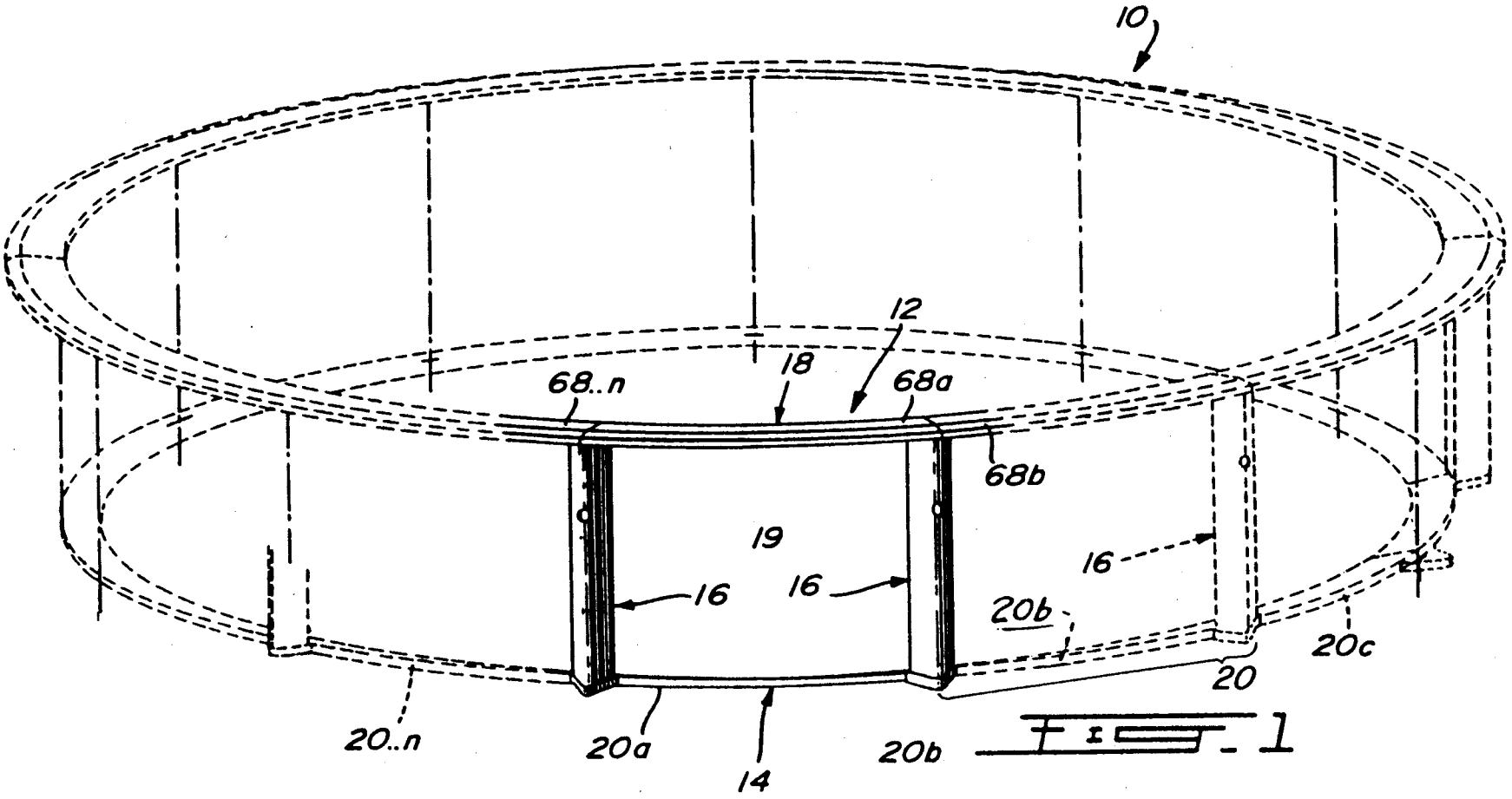
FIG. 1 is a perspective view partly in dotted lines showing an above-ground pool in accordance with the present invention.
Figure 2:
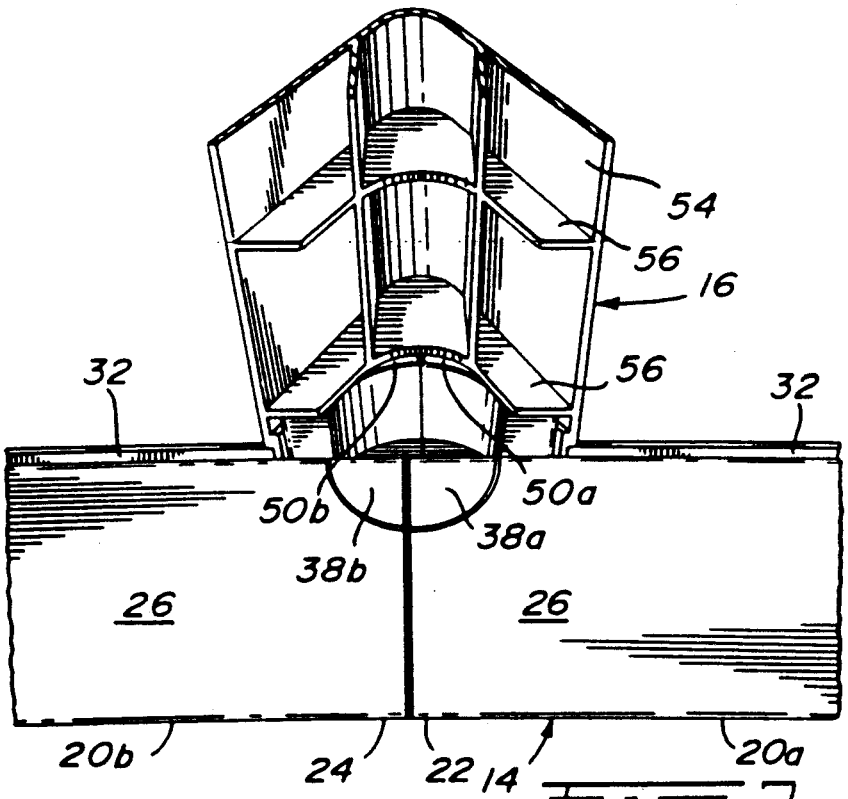
FIG. 2 is a fragmentary enlarged perspective view of a detail of the framework of the above-ground pool shown in FIG. 1.
Figure 3:
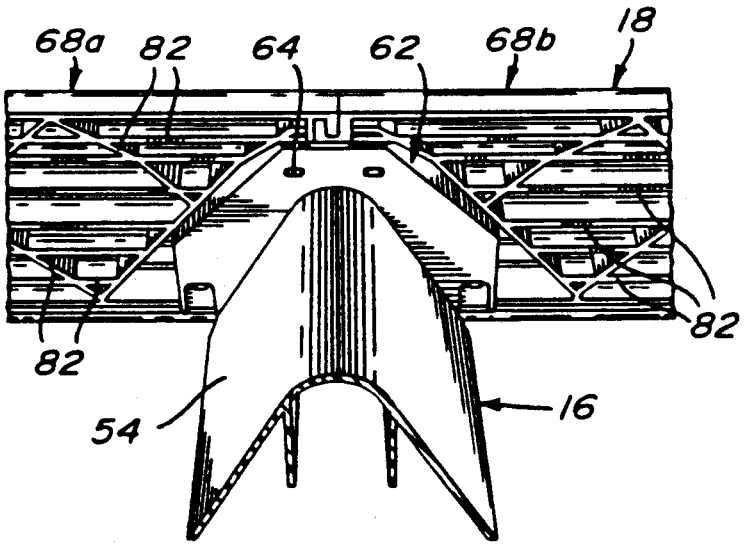
FIG. 3 is an enlarged fragmentary perspective of another detail of the framework of the embodiment shown in FIG. 1.

Referring now to the drawings, there is shown in FIG. 1 an above-ground swimming pool 10 having a circular outline and provided with a peripheral framework 12 made up generally of a base member 14, a plurality of spaced apart upright posts 16 set in the base member 14 and topped of by a peripheral coping 18 which sits on the top of the posts 16.

As in conventional pools a wall 19 of sheet metal extends throughout the internal periphery of the annular framework 12.

Referring now more specifically to FIGS. 2 and 4 through 6, there is shown the base member. In the present embodiment the base member is made up of a plurality of identical modular sections 20*a*, 20*b* . . . 20*n*. Each base member section 20 has a first end 22 with a male interconnection and a second end 24 with a female complementary interconnection, as will be described later.

The base member section 20 also includes a cove 26. The cove 26, which is integrally molded as part of the base member section 20, includes a sloping top wall 28 and reinforcing support ribs 30 underneath the wall 28. In conventional pools, coves are often made up by spreading earth or sand in a sloping manner up towards the wall of the annular framework forming the out of ground pool. The purpose of the cove is to prevent the flexible liner from being pinched at the base of the framework and to provide a smooth surface for the liner to merge with the vertical portion thereof.

The base member section also includes a groove 32 and complementary post socket half sections 34*a* and 34*b* at each end 22 and 24 of the base member 20. In fact the male interconnection of the first end 22 and second end 24 are part of the half post socket sections 20 and the groove 32 extends uninterrupted throughout the length of the base member 20. When the base member sections 20 are joined together to form the base member 14 the groove is continuous and is adapted to receive the bottom edge of the sheet metal wall 19. As shown in FIG. 6, the first end 22 of a base member section 20*a* includes a male rib 46 adapted to engage and interlock in a female slot 44 defined by rib 48 on the second end 24 of an adjacent base member section 20*b*. The ribs 46, 48 and the slot 44 are each generally in a vertical plane which extends laterally relative to the base member 20.

Figure 4:
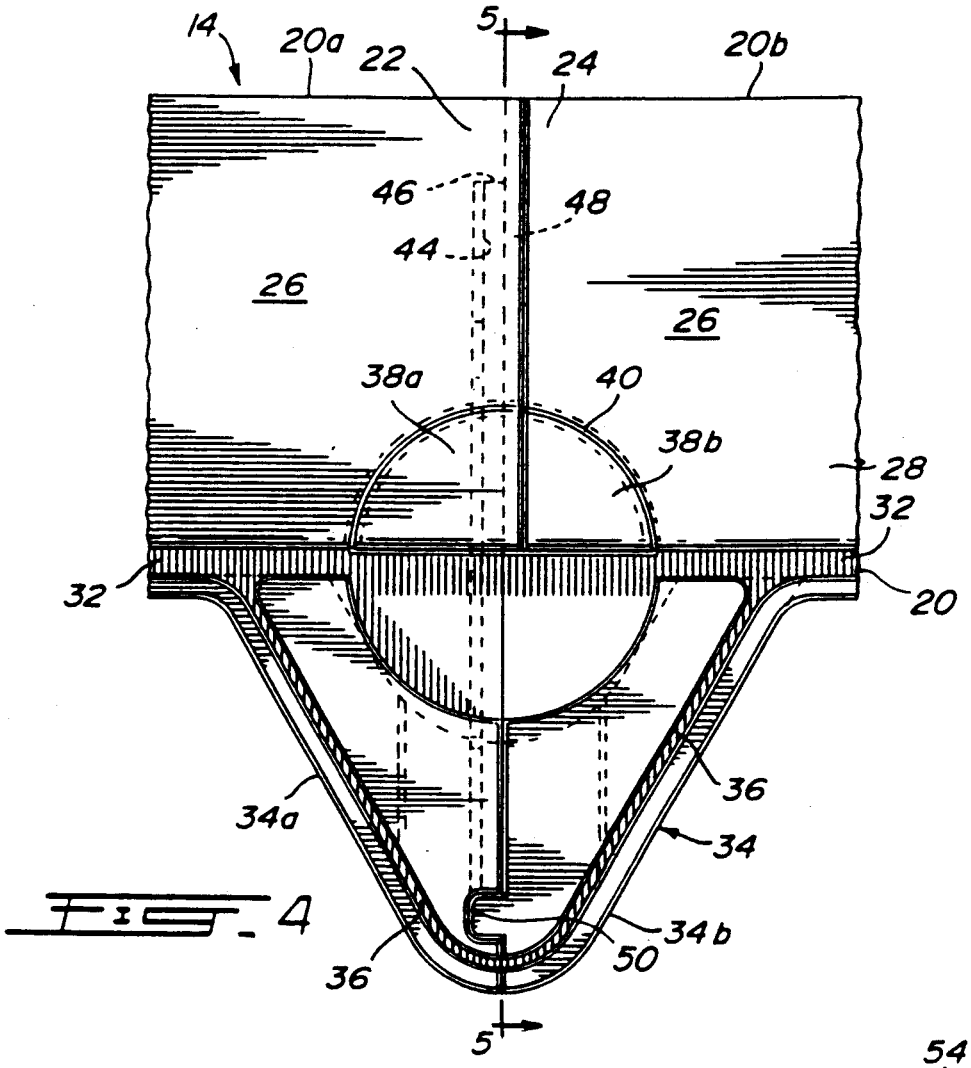
FIG. 4 is an enlarged fragmentary top plan view of a further detail thereof taken generally in the direction of line 4—4 shown in FIG.

In the present embodiment the post socket 34 is formed at the ends 22 and 24 of base member sections 20*a* and 20*b* respectively. As shown in FIG. 4, the post socket 34 includes a first socket portion 34*a* which has a male interlock arrangement similar to the ends 22 and 24 of the base members 20*a* and 20*b*. The other portion of the post socket is represented by the numeral 34*b* and represents the female complementary interlock portion. When the base member sections are interlocked together, as shown in FIG. 4, the post socket segments 34*a* and 34*b* are joined together to form a post socket 34 with a groove 36 extending about the periphery of the triangular shape post socket 34.

Figure 5:
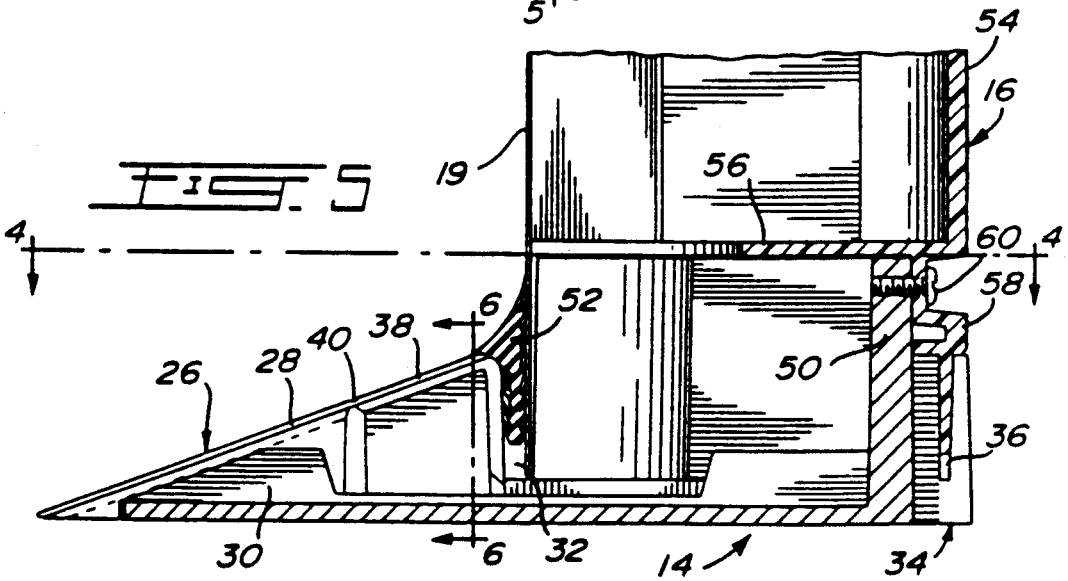
FIG. 5 is a fragmentary enlarged vertical cross-section taken along line 5—5 of FIG. 4.
Figure 7:
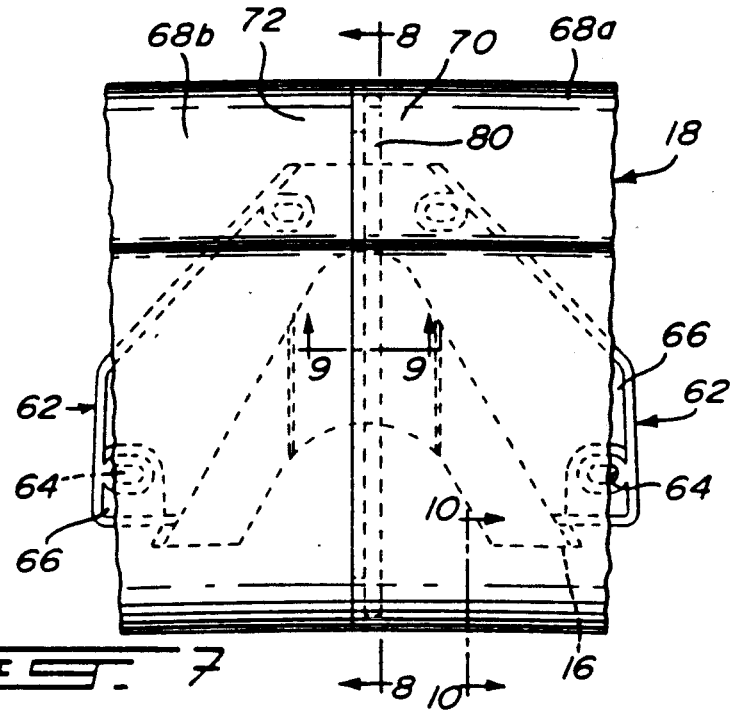
FIG. 7 is an enlarged fragmentary top plan view of a further detail of the present invention.

The individual posts 16 include a post foot 58 having a V-shape member adapted to fit within the groove 36. The post foot 58 is illustrated in FIG. 5. Finally, a screw 60 is adapted to extend through the post foot 58, as shown in FIG. 5, and to lock the post foot with the wall 50 of the post socket 34.

A knock-out portion 38 is provided at the interface between the ends 22 and 24 in the cove 26. The knock-out portion 38 extends into the wall 28 of the cove 26 as shown in FIG. 4. The knock out portion is made up of portions 38*a* and 38*b* in the respective ends 22 and 24. A frangible line 40 extends in a circular path in the wall 28 of the cove 26 as shown in the drawings, especially in FIG. 6. Ribs 42 which are integral with the knock-out portion 38 help to support the knock-out portion when it is integral with the wall 28 for instance.

The knock-out portion 38 is molded integrally with each base member section 20 but is only utilized when it is coincident with the post 16 at which the sheet metal wall 19 is being seamed. A seam for the ends of the sheet metal wall 19 requires a series of fasteners such as bolts and nuts spaced apart vertically. In particular it is necessary to provide such nuts and bolts at the bottom of the seam which would normally be covered by the cove 26. The knock-out portion 38 which would be coincident with the seam, once the swimming pool is assembled, and would be removed to allow access to the bottom of the seam. The other knock-out portions 38 would be left integral with the base members.

A flexible molded elongated strip insert 52 is illustrated in FIG. 5. This insert 52 is inserted into the groove 32 adjacent the bottom edge of the sheet metal wall 19 in order to block the wall in the groove 32. The insert 52 is provided with a concavely curved surface which merges with the top wall 28 of the cove 26. Reverse locking legs can be provided on the insert 52 to render the insert difficult to strip because of the resilience of the legs within the groove.

The post 16 includes a V-shape post wall 54 with reinforcing ribs 56 extending internally thereof and facing the interior of the pool which will in fact be covered by the sheet metal wall 19. The top of the post 36 is provided with a shoe 62 which has four openings 64 for passing screws therethrough from underneath the shoe 62. The shoe 62 in fact comprises a flange 66 which extends at right angles to the axis of the post 16.

The coping 18 is made up of a series of coping segments 68*a*, 68*b* . . . *n*. Each coping segment 68*a* and 68*b* is interlocked over a respective post 16 such that the two end portions 70 and 72 of respective coping segments 68*a* and 68*b* are interlocked over the shoe 62.

Figure 9:
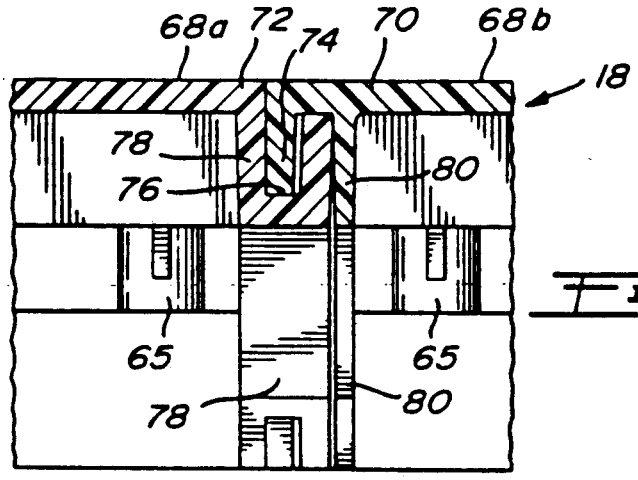
FIG. 9 is an enlarged fragmentary vertical cross-section taken along line 9—9 of FIG. 7.

The ends 70 and 72 of the coping segments 68*a* and 68*b* are similar to the base member sections 20*a* and 20*b* and they include male and female interlocking vertical ribs. Referring to FIG. 9, the end 70 of coping segment 68*a* is provided with a female slot 76 defined by rib and flange 78 while the end 72 of the coping segment 68*b* includes a male rib 74 which engages in the slot 76. A further reinforcing rib 80 is provided adjacent the rib 74. Bolt sockets 65 are provided on the under side of the coping segments 68*a* and 68*b* , and these are made to coincide with the bolt openings 64 in the shoe 62. When the coping segments 68*a* and 68*b* are mounted on the post 16 screws are passed through the openings 64 and engaged in the threaded bolt sockets 65 to retain the coping segments thereon. No further caps are required at the connections of the coping segments as in conventional pool constructions.

Figure 10:
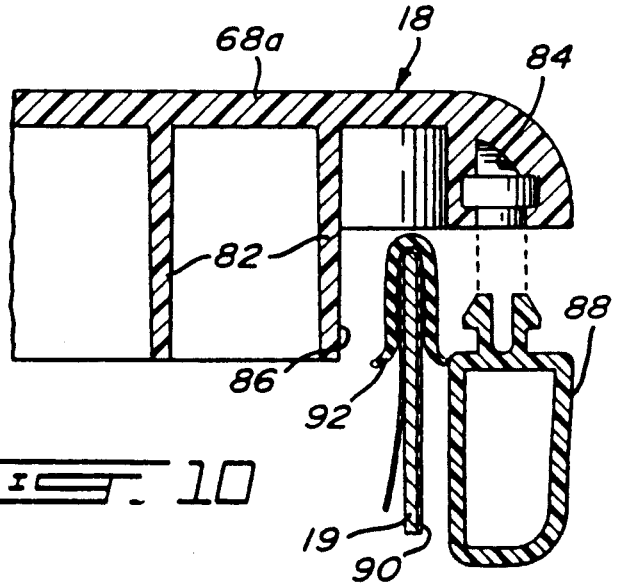
FIG. 10 is an enlarged fragmentary vertical cross-section partly exploded taken along line 10—10 of FIG. 7.

The coping segments 68 are molded and include a plurality of intersecting reinforcing ribs 82 on the under side thereof. On the portion of the coping which faces inwardly of the pool a shoulder 86 is provided for receiving the top edge of the sheet metal wall 19. A groove 84 is provided in the overhang portion of the coping and an elongated molded extruded locking strip 88 is adapted to be anchored in the groove 84 to lock the top edge of the sheet metal wall 19 against the shoulder 86. FIG. 10 shows the pool liner 90, which is of flexible sheet material, and passes over the top edge of the sheet metal wall 19 and can be held there by a U-shape elongated clip member 92. There are various ways of anchoring the liner 90 at the top of the wall.

Each of the posts 16 is provided with a socket 94 for receiving a fence rod 96. The fence rod 96 has a locking head 98 which coacts with the socket 94 in a bayonet fashion. Although not shown, the rod 96 extends over the top of the coping 18 to which fence members can be mounted as a security feature for the pool.

As is evident from the above description, all of the members in the present embodiment, such as the base member sections 20 which include the portion defining the groove 32, the cove 26, and the post socket segments 34, are molded in one piece. The posts 16, including the post foot 58 and the shoe 62, are molded as single individual separate modular members. The coping segments 68 are identical and are each molded as one piece.

When it is required to assemble the pool in accordance with the present embodiment, all of the base member sections 20*a*, 20*b*, . . . 20*n*, are connected end to end in a circle. The members 20*a* . . . 20*n* are connected by interlocking the ends 22 and 24 thereof and then the posts 16 are mounted individually to each post socket 94 and are bolted thereto once each post foot 58 is inserted a respective groove 36. The posts 16 are upright and stable because of the base member 14, and the coping segments 68 can then be inserted on the top of the posts 16, as described earlier, to form the coping 18. The sheet metal wall 19 is then unrolled and the bottom edge thereof inserted in the groove 32 with the insert 52 to block it. The seam is then formed at a selected post to which the knock-out portion 38 has been removed from the cove 26 thereof and the vinyl liner 90 is set up with the edges of the liner 90 anchored to the top edge of the sheet metal wall 19. The top edge of the sheet metal wall 19 should be abutted against the shoulder 86, and the locking strip 88 is inserted into the groove 84 to lock the top of the wall 19 against the shoulder 86.

Other embodiments can be contemplated, including where the post sockets 34 are intermediate the ends 22 and 24 of the base member sections 20. The base members may be in several sections including the post socket 34 as a separate section to be connected to the ends of the base sections 20. Furthermore, the coves 26 could be separate from the stems defining the grooves. However, the interlocking would include overlapping ribs, including male and female connections, or any other interlocking mechanism which can be molded. The post 16 of course could be molded without the shoe and the shoe be part of the coping sections.

It has also been contemplated that a pair of half posts, coping segments and a base segment, as shown in full lines in FIG. 1, be molded in one piece. They can then be interconnected one to the other as with the base member sections and coping segments.

We claim:

1. A framework for an above-ground pool comprising an uninterrupted base member made up of a plurality of molded interconnected base member sections defining a continuous groove for receiving a retaining wall, the base member also including spaced-apart sockets for receiving upright posts, each interconnected base member section having a first and a second end, wherein the first end of one base member section includes a first portion of a post socket molded integrally thereat and the second end of the base member section includes a complementary second portion of the post socket molded integrally thereat, whereby said groove is defined in the base member section and the first and second socket portions in an uninterrupted fashion, and wherein the first end of the base member section and the first post socket portion include a male connecting portion in a vertical plane extending laterally to the base member, and the second end of the base member section and the second post socket portion include a female connecting portion in a vertical plane extending laterally to the base member for engaging and interlocking with the first end of an adjacent base member section, a plurality of upright posts with each post including a post foot for engaging the interlocked post socket, whereby the post foot locks the mated interconnected base member sections and post socket portions together, an uninterrupted coping extending along the top of the posts, and means provided on the coping to receive the top of the posts and fasteners securing the posts to the post sockets and to the coping, the coping including interconnecting coping segments with each segment including a first and second end, the first end having a male connecting portion in a vertical plane extending laterally to the coping member and the second end having a female connecting portion in a vertical plane extending laterally to the coping member to engage and be interlocked with the first end of an adjacent coping segment, fastening means for fastening the coping members to the post, whereby the coping members retain the upper edge of the retaining wall.

2. A framework as defined in claim 1, wherein each base member section includes a co-extensive cove section molded integrally therewith, and the male connecting portions of the first end of the base member extend in alignment across the base member section and the cove member and the female connecting member of the second end of the base member extending across the second end of the base member and the cove member.

3. A frame work as defined in claim 2, wherein said cove section is integrally molded therewith and is coextensive with the base member section and post socket portions, and frangible knock-out portions are provided in the cove section to coincide with the centerline of an upright post such that a knock-out portion of the cove section can be knocked-out when a retaining wall seam is provided at a particular post.

4. A framework as defined in claim 1, wherein the post socket includes an upstanding short wall portion and the post foot includes a wall member having an internal surface and the upstanding short wall of the post socket abuts the internal surface of the post wall and a groove surrounding the upstanding short wall portion is receiving the post foot wall and fastening means cooperates with the post foot and the upstanding short wall of the socket for securing the post to the socket.

5. A framework as defined in claim 1, wherein the upright post is a molded elongated member with said post foot engaged and secured in the post socket of the base member, reinforcing means maintains the post relatively rigid and a shoe at the top of the post is provided for receiving the coping wherein the shoe includes a flange member at right angles to the post and fastening means are provided for attaching the coping to the flange member.

6. A framework as defined in claim 5, wherein the post is provided with a socket to receive an interlocking head of an elongated upright fence extension member whereby a fence can be mounted on the framework.

7. A framework as defined in claim 1, wherein the posts are provided with a shoe at the top thereof wherein the shoe includes a flange member extending at right angles to the vertical axis of the post and fastening means are provided for attaching the coping to the flanges.

8. A framework as defined in claim 7, wherein the coping is provided with a receiving notch for the upper edge of the retaining wall wherein a removable locking member is provided for locking the retaining wall in the notch formed in the coping.

9. A framework as defined in claim 8, wherein locking means includes an elongated groove defined in the coping adjacent the notch and an elongated flexible strip having anchor means adapted to be engaged in the groove in the coping, and the strip projecting downwardly from the ledge to form a slot for receiving the upper edge of a retaining wall.

10. A framework as defined in claim 7, wherein the coping segments interconnect end to end at a post location such that the first end of a coping segment is fastened to a portion of the shoe while a second end of an adjacent coping segment is fastened to another portion of the same shoe on the post.

11. A framework as defined in claim 1, wherein a resilient elongated insert strip is provided to be inserted into the groove to retain the lower edge of a retaining wall in the groove.

12. A framework for an above-ground pool comprising an uninterrupted base member made up of a plurality of molded interconnected base member sections defining a continuous groove for receiving a retaining wall, the base member also including spaced-apart sockets for receiving upright posts, each interconnected base member section having a first and a second end, wherein the first end of one base member section includes a first portion of a post socket molded integrally thereat and the second end of the base member section includes a complementary second portion of the post socket molded integrally thereat, whereby said groove is defined in the base member section and the first and second socket portions in an uninterrupted fashion, and wherein the first end of the base member section and the first post socket portion include a male connecting portion in a vertical plane extending laterally to the base member, and the second end of the base member section and the second post socket portion include a female connecting portion in a vertical plane extending laterally to the base member for engaging and interlocking with the first end of an adjacent base member section, a plurality of upright posts with each post including a post foot for engaging the interlocked post socket, whereby the post foot locks the mated interconnected base member sections and post socket portions together, an uninterrupted coping extending along the top of the posts, and means provided on the coping to receive the top of the posts and fasteners securing the posts to the post sockets and to the coping.

* * * * *